US007779962B2

(12) United States Patent
Zhang

(10) Patent No.: US 7,779,962 B2
(45) Date of Patent: Aug. 24, 2010

(54) MUFFLER

(76) Inventor: Guobiao Zhang, Garage #8-#8, Changzhao Road, East City, Shaoxing, Zhejiang (CN) 312000

( * ) Notice: Subject to any disclaimer, the term of this patent is extended or adjusted under 35 U.S.C. 154(b) by 112 days.

(21) Appl. No.: 10/526,969

(22) PCT Filed: Aug. 19, 2003

(86) PCT No.: PCT/CN03/00689

§ 371 (c)(1),
(2), (4) Date: Mar. 7, 2005

(87) PCT Pub. No.: WO2004/022932

PCT Pub. Date: Mar. 18, 2004

(65) Prior Publication Data

US 2006/0065477 A1 Mar. 30, 2006

(30) Foreign Application Priority Data

Sep. 8, 2002 (CN) ..... 02 1 28462

(51) Int. Cl.
*F16K 17/02* (2006.01)
*F01N 1/08* (2006.01)

(52) U.S. Cl. ..... 181/237; 181/226; 181/254; 60/324

(58) Field of Classification Search ..... 181/226, 181/237, 241, 254, 255, 263, 278, 279, 280, 181/379, 380; 60/324; 137/527, 527.6
See application file for complete search history.

(56) References Cited

U.S. PATENT DOCUMENTS 733,330 A * 7/1903 New ..... 181/278
2,074,651 A * 3/1937 Huffman et al. ..... 188/273
3,219,144 A * 11/1965 Murray et al. ..... 181/278
3,884,664 A 5/1975 Edwards ..... 62/296
3,977,381 A * 8/1976 Fujikawa et al. ..... 123/568.2
4,048,968 A * 9/1977 Aoyama ..... 123/568.15
4,736,728 A * 4/1988 Takahashi et al. ..... 123/568.27
4,903,486 A * 2/1990 Finkle ..... 60/324
5,489,753 A * 2/1996 Gibel ..... 181/230
5,520,159 A * 5/1996 Pao et al. ..... 123/568.27
5,785,014 A * 7/1998 Cornwell ..... 123/65 PE
5,821,474 A * 10/1998 Olszok et al. ..... 181/254
5,917,161 A * 6/1999 Fuhrmann ..... 181/237
6,338,246 B2 * 1/2002 Eguchi et al. ..... 60/324
6,564,902 B1 * 5/2003 Saberi ..... 181/237

(Continued)

FOREIGN PATENT DOCUMENTS

DE 100 20 491.0 * 4/2000

(Continued)

*Primary Examiner*—Jeffrey Donels
*Assistant Examiner*—Jeremy Luks
(74) *Attorney, Agent, or Firm*—Maier & Maier, PLLC

(57) ABSTRACT

A muffler is disclosed. In the muffler a throttling device that is controlled by the energy of the airflow to be muffled is provided in a pipeline of the airflow that needs to be muffled. The muffler is adjusted by itself according to random variety of the pulsing airflow, and can eliminate or reduce effectively the pulsation of the airflow and the related noise in the range of the low frequency and the middle frequency. The muffling effect of the muffler has no correlation with the volume of the muffler, and therefore the volume of the muffler can be reduced.

28 Claims, 1 Drawing Sheet

U.S. PATENT DOCUMENTS

| | | | | |
|---|---|---|---|---|
| 2002/0005318 | A1* | 1/2002 | Schumacher et al. | 181/237 |
| 2002/0175022 | A1* | 11/2002 | Schumacher et al. | 181/254 |
| 2005/0067218 | A1* | 3/2005 | Bristow et al. | 181/237 |

FOREIGN PATENT DOCUMENTS

| | | |
|---|---|---|
| JP | 58-217714 | 12/1983 |
| JP | 5-86834 | 4/1993 |
| JP | 8-42321 | 2/1996 |

* cited by examiner

MUFFLER

This is a nationalization of PCT/CN03/000689 filed Aug. 19, 2003 and published in Chinese.

FIELD OF THE INVENTION

This invention relates to a muffler, more particularly, to a muffler for eliminating or reducing effectively the gas flow pulsation and the noise caused thereby.

DESCRIPTION OF THE RELATED ART

A muffler is used to reduce noise by utilizing mainly aerodynamic attenuating principle, such as sound absorption, expansion, resonance and so on, the level of researches and development associated with the structures and the principles of the muffler is very high. By patent searching it is found that Only in China the number of the patents associated with mufflers is more than 600. The mufflers in these patents are various, but they have a common ground, that is, the structures of the mufflers are unchangeable so that they can't be provided with a mechanism which is capable of realizing self-adjustment automatically with respect to change of the pulsating gas flow, now although there are some adjusting devices provided for them, these devices only can be adjusted manually. Sound-deadening characteristic of the mufflers having the unchangeable structure is unchangeable, but variation of pulsation of gas flow is random and the mufflers having the unchangeable structure are therefore always in a passive state in operation, anechoic effect can not be perfect. At present, it still has not found a muffler which can change positively with respect to the pulsating gas flow and realize self-adjustment. In practice, the muffler is normally used to reduce noise of discharging gas of reciprocating engines and gas compressors, which are originated from pulsation of discharging gas. Generally, it is more difficult to reduce or eliminate the pulsation in low-frequency and medium-frequency than that in high-frequency. At present, it still can not provide a novel, light-weighted and small-sized muffler which can reduce effectively gas flow pulsation in low-frequency.

SUMMARY OF THE INVENTION

To solve the problems in the art, the object of the invention is to design a muffler which can not only realize self-adjustment with respect to the random change of the pulsating gas flow but eliminate or reduce effectively the gas flow pulsation in low-frequency and medium-frequency and the noise caused thereby.

In order to realize the object, the invention is to provide a muffler which comprises a casing within which is a gas inlet, a gas chamber and a gas outlet, a throttling device which is located in gas flow route and controlled by the pressure of gas flow. The throttling device controlled by pressure of gas flow is a pressure reducing valves structure. The pressure reducing valves structure includes an adjusting device and a throttling device. The adjusting device comprises a manual adjusting device, a spring, an energy sensor member and a connection lever which are connected in series. The throttling device comprises an open and close member and a fixture.

Compared with the conventional muffler, the muffler according to the invention has significantly advantages and positive effects as follows: 1. It can realize self-adjustment with respect to the random change of the pulsating gas flow. 2. It can eliminate or reduce effectively the pulsation of gas flow in low-frequency and medium-frequency which is difficult to eliminate and the noise caused thereby. 3. It can reduce the volume of the muffler because the anechoic effect is not much dependent on it.

BRIEF DESCRIPTION OF THE DRAWINGS

Embodiments of the invention will now be further described with reference to the accompanying drawing.

DETAILED DESCRIPTION OF THE INVENTION

Figure 1:
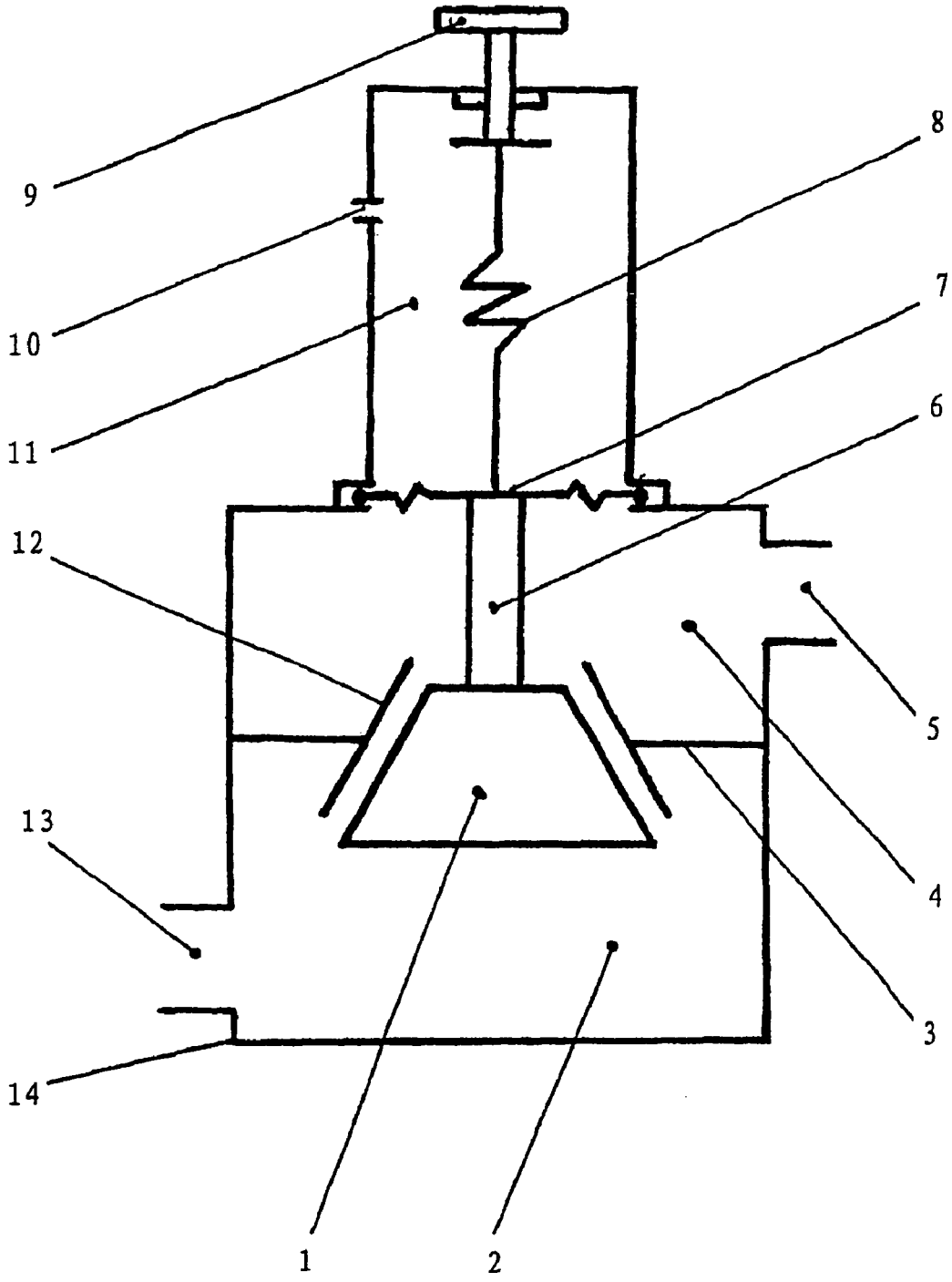
FIG. 1 is schematic viewing showing structural principle of a muffler according to the invention.

As shown in FIG. 1, a muffler casing 14 is divided into a gas inlet chamber 2 communicated with a gas inlet 13 and a gas outlet chamber 4 communicated with a gas outlet 5 by a partition 3, one throttling device is constructed of an open and close component 1 and a fixture 12 on the partition 3, when the open and close component 1 moves upwardly as shown in the FIGURE, the area of the flow cross-section will decrease, whereas it will increase. The muffled gas flow flows into the gas chamber 2 through the gas inlet 13, and is throttled by the throttling device and into the outlet chamber 4, then discharges from the gas outlet 5. In this embodiment, the adjusting device consisting of a manual adjusting device 9, a spring 8, an energy sensor member 7 and a connection lever 6 which are connected in turn is located on the upper portion of the casing. The energy sensor member 7 is a diaphragm in this embodiment and sensible for potential energy of the muffled gas flow chiefly. The energy sensor member 7 also can be selected from a piston, a bellows etc. The gas outlet chamber 4 is located on the lower portion of the energy sensor member 7 and a spring chamber 11 is located on the upper portion thereof and communicated with atmosphere through a balancing hole 10. The energy sensor member 7 in the gas outlet chamber 4 is connected with the open and close member 1 and fixed thereon by the connection lever 6 and in the spring chamber 11 is connected with the end of the spring 8. The other end of the spring 8 is connected with the manual adjusting device 9 fixed on the casing 14, which adjusts the spring force acted on the energy sensor member 7 by the spring 8 in a manner that the predetermined compressive value of the spring 8 can be adjusted. Now analyze the force of the energy sensor member 7 at the balancing position, if P is represented for the gas pressure in the gas outlet chamber 4, S is for the effective area of the diaphragm (energy sensor member 7), F is for the spring force and G is for the gravity, and because the amount of the deformation force of the diaphragm and the fluid force at throttled point is relatively small, they can be ignored, the force applied by the gas flow in gas outlet chamber 4 is equal to the spring force plus gravity, $P*S=F+G$, $P=(F+G)/S$, the gas pressure in the gas outlet chamber 4 is dependent on the amount of the spring force, so that the pressure at the balancing point can be set by the spring force adjusted by the manual adjusting device 9. The amount of displacement of the open and close member 1 is very small in operation so that the change of the spring force is small and the change of the gas pressure in the gas outlet chamber 4 is also small. The energy sensor member 7 is located on its undermost position under the action of the spring force and gravity when the muffler is not in operation, where the area of the flow cross-section of throttling device is the largest. After the pulsating gas flow enters the muffler, gas energy in the gas outlet chamber 4 increases, the pressure therefore increases, once the gas force is larger than the spring force, the movement of the energy sensor member 7 drives the open and close member 1 to move upwardly, the throttling device starts to work and is therefore controlled by the muffled gas self-energy. When the muffler is in the balancing position, if the energy of the muffed gas flow continues to increase, the pressure keeps up increasing, then the open and close member 1 is driven by the energy sensor member 7 to move upwardly, the area of the flow cross-section decreases, the pressure decreases, which leads to a trend that the pressure in gas outlet chamber 4 decreases to the pressure at balancing point, whereas when energy decreases, the pressure decreases, the open and close component 1 moves downwardly, then the area of the flow cross-section increases, which leads to a trend that the pressure in the gas outlet chamber 4 recovers to the pressure at the balancing point. It can be determined that the pressure fluctuation of the gas outlet chamber will be very small. Since the discharge duct is fixed, the gas flow discharged is continuous, stable and no pulsation. It can be analyzed from the point of the pulsating gas flow, the pulse waveform whose pressure is greater than the pressure at the balancing point will be intercepted, the energy intercepted will be stored in the gas inlet chamber 2 and previous ducts so that the pulsating energy whose pressure is lower than the pressure at the balancing point increases, and when it cooperates with the method of increasing the area of the flow cross-section, the energy of the gas flow will be much more uniform than before, which corresponds with the case that pulse waveform of gas flow is commutated to be approximately a line. The pressure in the gas outlet chamber 4 at the balancing pressure can be considered comprehensively so as to be set according to the factors, such as the average value of the pulsating gas flow, the continuity and stability of the muffed gas flow required and gas resistance. It can be made out that the anechoic effect is not much dependent on the volume of the muffler on the basis of the working principle thereof. The open and close member 1, the diaphragm (energy sensor member 7) and the spring 8 can be regarded as a mass-spring vibrating system having its nature frequency, for which the pulsation of the gas flow is a stimulant force, when the pulsation of the gas flow is in low-frequency and medium-frequency, the vibrating system consisting of the open and close member, the diaphragm and the spring can be substantially in response to said frequency and carry out the adjustment, the response of the system is relatively small when in the high-frequency, so that the adjusting function is relatively weak, the muffler is more effective when the gas flow is in low-frequency than in high-frequency.

The gas inlet 13 and gas outlet 5 in the embodiment as above said can be exchanged each other, accordingly, the gas inlet chamber 2 and the gas outlet chamber 4 can be exchanged each other, too, the working principle is similar to above-mentioned embodiment, and it can obtain the same effect.

In addition, as shown in FIG. 1, the structure of the open and close member 1 is characterized in that a cross sectional area of its first surface subjecting to gas pressure from the gas inlet 13 is larger than a cross sectional area of its second surface that is opposite to the first surface and exposes to the gas outlet 5.

The means according to the invention can be used in series to further improve stability of gas flow and reduce noise; the parallel usage of the means can enhance flowing capacity, and it also can be used with common mufflers cooperatively.

The invention claimed is:

1. A muffler comprising:

a casing comprising a partition having an aperture defined therein, wherein the partition is coupled to the casing and defines a gas inlet chamber communicating with a gas inlet and a gas outlet chamber communicating with a gas outlet;

a pressure sensor member; and a throttling device is located between the inlet and outlet of the muffler and controlled by pressure of the gas flow, wherein a cross sectional area of the gas flow of the throttling device reduces when pressure of the gas flow increases, the throttling device further comprising an open and close member having a connection lever coupled thereto, wherein the open and close member is coupled to the pressure sensor member using the connection lever and is substantially within the aperture of the partition.

2. The muffler according to claim 1, wherein the throttling device controlled by pressure of the gas flow is a pressure reducing valves structure.

3. The muffler according to claim 2, wherein the pressure reducing valves structure comprises an adjusting device and a throttling member.

4. The muffler according to claim 3, wherein the adjusting device comprises a manual adjusting device, a spring, the pressure sensor member and a connection lever which are connected in series.

5. The muffler according to claim 1, wherein the throttling device comprises an open and close member and a fixture.

6. The muffler according to claim 1, wherein the throttling device comprises an open and close member and a fixture; and wherein the structure of the open and close member is characterized in that a cross sectional area of its first surface subjecting to gas pressure from the gas inlet is larger than a cross sectional area of its second surface that is positioned opposite to the first surface and positioned within the gas outlet chamber.

7. The muffler according to claim 4, wherein the throttling member comprises an open and close member and a fixture; and wherein the structure of the open and close member is characterized in that a cross sectional area of its first surface subjecting to gas pressure from the gas inlet is larger than a cross sectional area of its second surface that is positioned opposite to the first surface and positioned within the gas outlet chamber.

8. The muffler according to claim 4, wherein the pressure sensor member is a diaphragm, a piston or a bellows.

9. The muffler according to claim 7, wherein the connection lever of the adjusting device is connected with the second surface of the open and close member.

10. The muffler according to claim 9, wherein the pressure sensor member is a diaphragm, a piston or a bellows.

11. The muffler according to claim 10, wherein a spring chamber is connected with the gas outlet chamber; wherein the spring and a part of the manual adjusting device are located within the spring chamber; and wherein the spring chamber comprises a balancing hole communicating with the atmosphere.

12. The muffler according to claim 7, wherein gas flow discharged from the gas outlet is continuous, stable and without pulsation.

13. The muffler according to claim 11, wherein gas flow discharged from the gas outlet is continuous, stable and without pulsation.

14. The muffler according to claim 1, wherein the pressure sensor member is coupled to the gas outlet chamber and the throttling device being controlled by the pressure of the muffled gas flow.

15. The muffler according to claim 1, wherein the pressure sensor member is a diaphragm, a piston or a bellows and coupled to the casing.

16. The muffler according to claim 14, wherein the pressure sensor member is a diaphragm, a piston or a bellows and coupled to the casing.

17. The muffler according to claim 1, wherein the muffler comprises a spring which is connected with the combination of the pressure sensor and the throttling device.

18. The muffler according to claim 14, wherein the muffler comprises a spring which is connected with the combination of the pressure sensor member and the throttling device.

19. The muffler according to claim 15, wherein the muffler comprises a spring which is connected with the combination of the pressure sensor member and the throttling device.

20. The muffler according to claim 16, wherein the muffler comprises a spring which is connected with the combination of the pressure sensor member and the throttling device.

21. The muffler according to claim 17, wherein the spring is connected with the pressure sensor.

22. The muffler according to claim 17, wherein the other end of the spring is connected with the casing.

23. The muffler according to claim 21, wherein the other end of the spring is connected with the casing.

24. The muffler according to claim 22, wherein a manual adjusting device connects other end of the spring and the casing.

25. The muffler according to claim 22, wherein the part of casing which is connecting the spring form a spring chamber.

26. The muffler according to claim 24, wherein the part of casing which is connecting the spring form a spring chamber.

27. The muffler according to claim 25, wherein the spring chamber comprises a balancing hole communicating with the atmosphere.

28. The muffler according to claim 1, further comprising a fixture coupled to the partition and positioned adjacent the aperture.

* * * * *